US007814921B1

(12) United States Patent
Ranieri et al.

(10) Patent No.: US 7,814,921 B1
(45) Date of Patent: Oct. 19, 2010

(54) MAST SUPPORTED SHADE CANOPY

(75) Inventors: Christopher Paul Ranieri, League City, TX (US); Charles C. Hendee, Houston, TX (US)

(73) Assignee: Hendee Enterprises, Inc., Houston, TX (US)

( * ) Notice: Subject to any disclaimer, the term of this patent is extended or adjusted under 35 U.S.C. 154(b) by 175 days.

(21) Appl. No.: 12/173,641

(22) Filed: Jul. 15, 2008

Related U.S. Application Data

(63) Continuation-in-part of application No. 11/608,704, filed on Dec. 8, 2006, now Pat. No. 7,516,577.

(51) Int. Cl.
*E04H 15/34* (2006.01)

(52) U.S. Cl. ..... 135/123; 135/159; 135/117; 52/83

(58) Field of Classification Search ..... 135/98–99, 135/121–123, 135, 147, 120.4, 159, 114, 135/119, 905, 908, 117; 52/82–83, 93.1–93.2, 52/126.1
See application file for complete search history.

(56) References Cited

U.S. PATENT DOCUMENTS

| | | | | | |
|---|---|---|---|---|---|
| 1,491,849 | A * | 4/1924 | Dickey | 135/98 |
| 1,631,215 | A * | 6/1927 | Leffert | 135/98 |
| 1,642,267 | A * | 9/1927 | Rush | 135/98 |
| 2,001,196 | A * | 5/1935 | Jost | 135/98 |
| 3,810,481 | A * | 5/1974 | Nohmura | 135/158 |
| 4,779,635 | A * | 10/1988 | Lynch | 135/97 |
| 4,890,634 | A * | 1/1990 | Dalo et al. | 135/99 |
| 5,000,211 | A * | 3/1991 | Speare et al. | 135/97 |
| 5,291,908 | A * | 3/1994 | Grady, II | 135/22 |
| 5,630,589 | A * | 5/1997 | Adie et al. | 473/474 |
| 6,638,199 | B2 * | 10/2003 | Annesi et al. | 482/27 |
| 6,814,094 | B1 * | 11/2004 | Barber | 135/119 |
| 6,874,518 | B2 * | 4/2005 | Porter | 135/124 |
| 7,316,237 | B2 | 1/2008 | Connelly | |
| 7,628,164 | B2 * | 12/2009 | Joen-an Ma | 135/121 |
| 2006/0156644 | A1 | 7/2006 | Connelly | |

* cited by examiner

*Primary Examiner*—Winnie Yip
(74) *Attorney, Agent, or Firm*—Buskop Law Group, PC; Wendy Buskop

(57) ABSTRACT

A shade structure having a suspended mast with a tubular body non-removably secured between at least two suspended mast support segments forming a suspended engagement. The shade structure has at least a first flange plate connecting a first mast transition segment to a first cantilever rafter and a second flange plate connecting a second mast transition segment to a second cantilever rafter. At least one column extension assembly simultaneously supports the cantilever rafters and connects each cantilever rafter to a column. A fabric canopy is disposed over and around the suspended mast and over the suspended mast support segments and cantilever rafters. Means to engage the fabric canopy is used with each cantilever rafter on a second cantilever rafter end and tensioning means secured to at least one of the cantilever rafter or the suspended mast is used for tensioning the fabric canopy.

7 Claims, 5 Drawing Sheets

MAST SUPPORTED SHADE CANOPY

CROSS REFERENCE TO RELATED MATTERS

The present application claims benefit of priority as a Continuation-in-Part of Ser. No. 11/608,704, which was filed Dec. 8, 2006, entitled "Fabric Structures with Tensioner and Tensioner Device" and is incorporated herein.

FIELD

The present embodiments relate to a shade canopy with a mast for covering children's playgrounds, lawn areas, car dealerships, garden centers and other outdoor events and venues.

BACKGROUND

A need exists for an adjustable and easily detachable shade canopy that has a strong central support.

A further need exists for a quick to install shade structure which can be used with winds up to 80 mph without twisting and deforming the shade structure.

A need exists for a detachable shade canopy to protect the structure from damage and the public from flying projectiles.

The present embodiments meet these needs.

BRIEF DESCRIPTION OF THE DRAWINGS

The detailed description will be better understood in conjunction with the accompanying drawings as follows.

Figure 1:
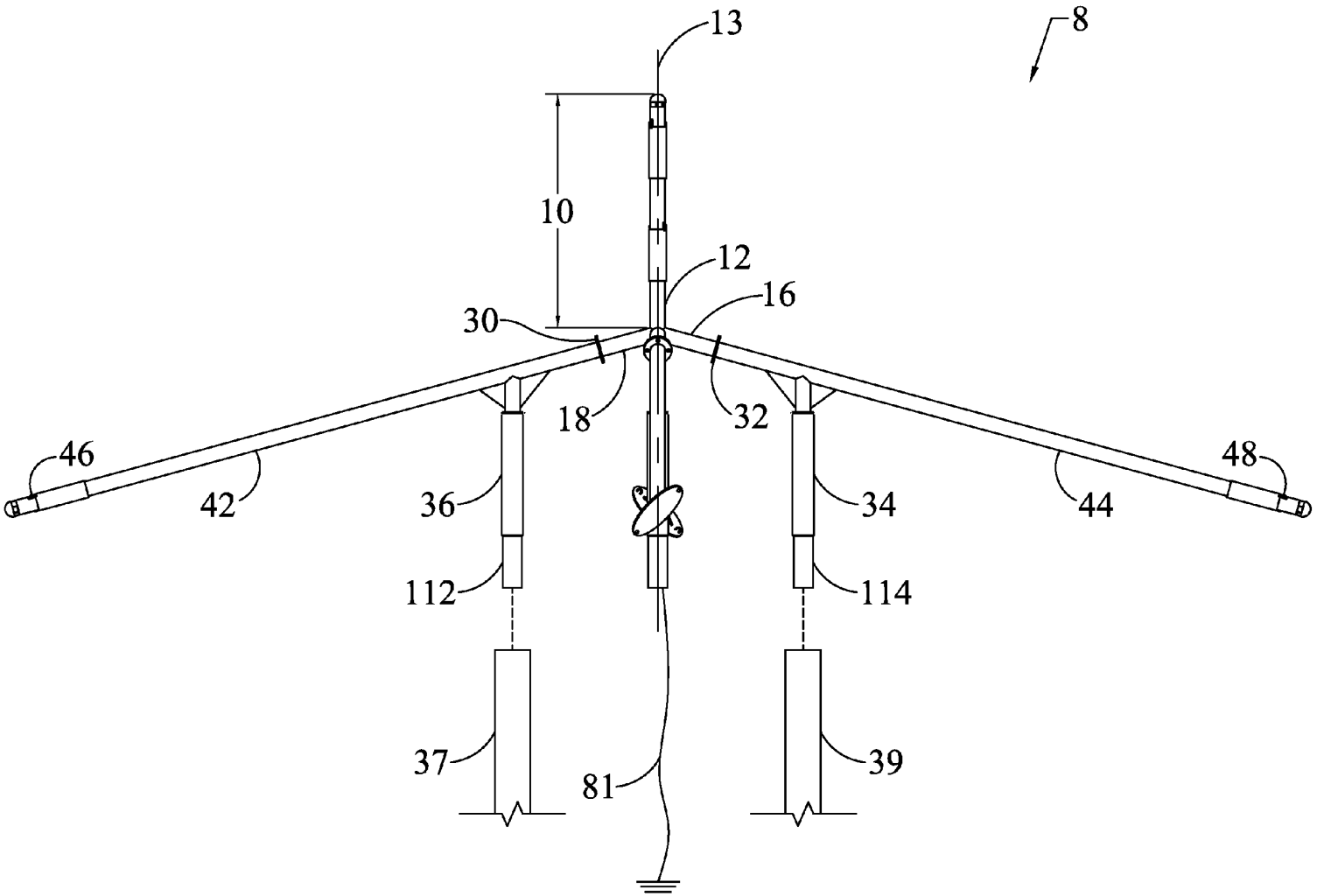
FIG. 1 is a prospective view of the mast supported shade canopy.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a mast supported shade canopy.

The shade structure can have a suspended mast with a tubular body non-removeably secured between at least two suspended mast support segments forming a suspended engagement. The shade structure can have at least a first flange plate connecting a first mast transition segment to a first cantilever rafter and a second flange plate connecting a second mast transition segment to a second cantilever rafter. At least one column extension assembly simultaneously supports the cantilever rafters and connects each cantilever rafter to a column. A fabric canopy is disposed over and around the suspended mast and over the suspended mast support segments and cantilever rafters. Means to engage the fabric canopy is used with each cantilever rafter on a second cantilever rafter end and a tensioner secured to at least one of the cantilever rafter or the suspended mast is used for tensioning the fabric canopy.

The canopy is a shade structure using a fabric material supported by a suspended mast that does not touch the ground with a plurality of mast transition segments.

The suspended mast can range from about 2 feet to about 20 feet long. The suspended mast can have an outer diameter ranging from about 8 inches to about 60 inches. The mast can have a tubular body with an inner diameter ranging between about 1 inch to about 8 inches. The suspended mast can be a tubular with a hollow center for less weight than solid masts.

The suspended mast can be a nested three part telescoping structure, having a lower section that supports a mid section which in turn supports an upper section, each section having a slightly smaller outer diameter than the lower section.

It is contemplated for the telescoping embodiment, the suspended mast can have threaded engagements between the telescoping segments insuring a secure fit. Additionally, in another embodiment, an O-ring or sealing structure can be used to prevent water from flowing down the segments, between segments, preventing degradation.

The suspended mast embodiment has the following benefits: the suspended mast is lightweight, and the suspended mast allows for multiple fabric panels.

In an embodiment, the suspended mast can be a tubular body made from steel, but aluminum or alloys of aluminum can be used. Coated alloys of iron can also be used in an embodiment of the tubular body. The tubular body can be made from magnesium or alloys of magnesium, titanium or alloys of titanium, graphite composite, polyvinyl chloride pipe or another reinforced polymer pipe. The wall thickness of the tubular body can range from about 4 gauge steel plate to about 18 gauge steel plate. The walls can be coated steel, such as to resist rusting or electrostatic shock, or to resist lightening strikes, or the tubular body can be a laminates of metal, having different physical properties for special needs.

The tubular body can be designed to maintain its shape and resist deformation in winds up to at least 85 mph, with the fabric canopy removed. The tubular body can be cylindrical in shape, rectangular in shape, octagonal in shape or have the shape of another polygon.

The tubular body has a vertical axis. The suspended mast is non-removably secured between at least two suspended mast support segments in a suspended engagement.

The suspended mast support segments are contemplated to be beams of steel, or similar structural material. These beams can be from about 1 foot to about 10 feet long. The beams can be hollow with a wall thickness ranging between about 1/16 inch to about 1 inch. The beams can be solid, and perforated to support other items, such as suspended lamps.

The suspended mast support segments can be used to support the suspended mast at an angle from about 90 degrees to about 160 degrees from the axis.

At least one flange plate can be used to connect each of the suspended mast support segments to a cantilever rafter. Each flange plate can be two plates bolted together. The flange plates are made from a metal or a tough polymer that is thick enough to resist deformation in high winds, such as 70 mph pre-hurricane strength winds.

The flange plates can be welded together or fastened with a plurality of locking dogs, rivets, or bolts and nuts. From about 2 bolts to about 14 bolts can be used to connect two usable flange plate segments together forming the flange plate. Additional bolts can further be used.

The flange plates can be made from the same materials as the tubular body. The flange plates, in an embodiment can be round, oblong, oval or rectangular, and have a thickness ranging from about ⅛ inch to about 1 inch. In an alternative embodiment the flange plates can be replaced with a sliding connection or friction connection.

At least one column support segment can be used to simultaneously support the cantilever rafters and connecting each cantilever rafter to a column. The column support segment can have diameters that provide an interference fit with the inner diameters of the columns.

The column support segment can be inserted into the columns. The column support segment can be connected to the columns by the use of a column connection plate, gussets, or similar joining plates. The column support segment can be connected to the column with one or more of a variety of fastening means, such as rivets, or adhesive. The adhesive can be an epoxy or other chemical bonding material.

In another embodiment, the column support segment can provide a sliding engagement with the columns. This embodiment contemplates that the column extension fits over the column. The column extension assemblies are intended to match the size and shapes of the columns, such that if the column is rectangular, the column extension is rectangular, and if the column has a 5 inch inner diameter, the column extension assembly has an inner diameter slightly less than the column forming an interference fit.

In an embodiment, the column support segment could have an inner diameter slightly larger than an outer diameter of the column, when the column extension assembly slides over the column in an interference fit. The outer diameter of the column can range from about 2 inches to about 12 inches.

A fabric canopy can be disposed around the suspended mast and over the suspended mast support segments and cantilever rafter.

The fabric can be a nylon, a solid, a non-woven fabric, a knit fabric, or combinations thereof. The fabric can be a cotton or blend of nylon with cotton, or even be Kevlar™, or another breathable but SPF and water resistant fabric. The fabric can have a thickness ranging from about 5 mil to about 40 mil. An example of a fabric can be knitted high density polyethylene. The fabric canopy can have a dimension ranging from about 9 square feet to about 1,000 square feet.

Additionally, the embodiment contemplates that various means can be used to engage the fabric canopy with each cantilever rafter on a second cantilever rafter end. Examples of some of these means to engage the fabric canopy can include shackles, pad eyes, hooks or similar connections.

A tensioner can be used within the suspended mast and/or at least one of the cantilever rafters for tensioning the fabric canopy.

The tensioner can be a turnbuckle, a sliding block with hook, a sliding cover with a hook, a bracket fitting or a cylindrical sliding block disposed within the at least one elongated rafter, wherein the cylindrical sliding block has an outer diameter substantially similar to an inner diameter of the elongate rafter, and wherein the cylindrical sliding block has a longitudinal threaded aperture for receiving the threaded rod and engaging the threads of the rod, and wherein the hook is attached to the cylindrical sliding block and the hook extends through the opening directly engaging the web strips and the fabric cover, and tensioning the fabric cover.

In an embodiment, the suspended mast can include a slot in the suspended mast. The suspended mast can have a rod disposed within. The rod that can have a smaller inner diameter than the hollow inner diameter of the tubular body.

The rod can be positioned to move along the interior of the mast along the axis adjacent the slot. The rod in an embodiment forms a threaded engagement with a sliding block also disposed within the tubular body of the mast. The sliding block is adapted to move along the rod parallel to the axis, and at least one attaching device is positioned to removeably engage the sliding block.

The attaching device, which can be a hook welded or removeably attached to the sliding block, protrudes through the slot, and a first fitting that can be a machined fitting adapted for insertion into a tube. The first fitting can secure the rod to the mast. The attaching device can be an end of the rod that is adapted to receive a drive means for rotating the rod enabling the sliding block to move along the rod.

The attaching device can be a pad eye, a hook, bolt, eye bolt, or combinations thereof.

The embodiments can further use a grounding wire secured to the suspended mast to ground the shade structure during a lightening strike.

In another embodiment, the tensioner can be disposed inside at least one of the cantilever rafters, as well as inside the suspended mast or in both of them, some of them or all of them.

An embodiment contemplates the tensioner to be in the mast, and in just one rafter. The tensioner can further be disposed on only one end of the suspended mast.

In another embodiment, the tensioner can be disposed on at least one of the second cantilever rafter end.

In still another embodiment it is contemplated that the suspended mast further can have at least one cover disposed around the tubular body for providing additional support, or to cover slots formed in the mast, to prevent water penetration and degradation from the elements.

It is contemplated that from 2 suspended mast support segments to about 8 suspended mast support segments can be connected to the suspended mast at an apex of the fabric canopy and overall frame structure.

In yet another embodiment, an end plate can be disposed on a second end of each cantilever rafter opposite the first end. The end plate provides an engagement with the fabric.

FIG. 1 depicts a version of the shade structure (8) with a suspended mast (10) having a tubular body (12) with a vertical axis (13).

The suspended mast is non-removably secured between a first suspended mast support segment (18) and a second suspended mast support segment (16) forming a suspended engagement.

A first flange plate (30) connects the first suspended mast support segment (18) to a first cantilever rafter (42) and a second flange plate (32) connects a second suspended mast support segment (16) to a second cantilever rafter (44).

FIG. 1 further shows two column extension assemblies. The first column extension assembly (36) is shown simultaneously supporting the first cantilever rafter (42) and connecting the first cantilever rafter to a first column (37).

The first column extension assembly (36) connects to the first column by a first connector piece (112). The first connector piece (112) can have an outer diameter allowing for it to slide within the column (37), or in the alternative the first connector piece (112) can have an inner diameter allowing it to slide over the column (37).

The second column extension assembly (34) is shown simultaneously supporting the second cantilever rafter (44) and connecting the second cantilever rafter to a second column (39). The second column extension assembly (34) connects to the second column (39) by a second connector piece (114). The second connector piece (114) can have an outer diameter allowing for it to slide within the column (39), or in the alternative the first connector piece (112) can have an inner diameter allowing it to slide over the first column (39). Dotted lines are used to show the first connector piece (112) going into the first column (37) and for the second connector piece (114) going into the second column (39).

Figure 2:
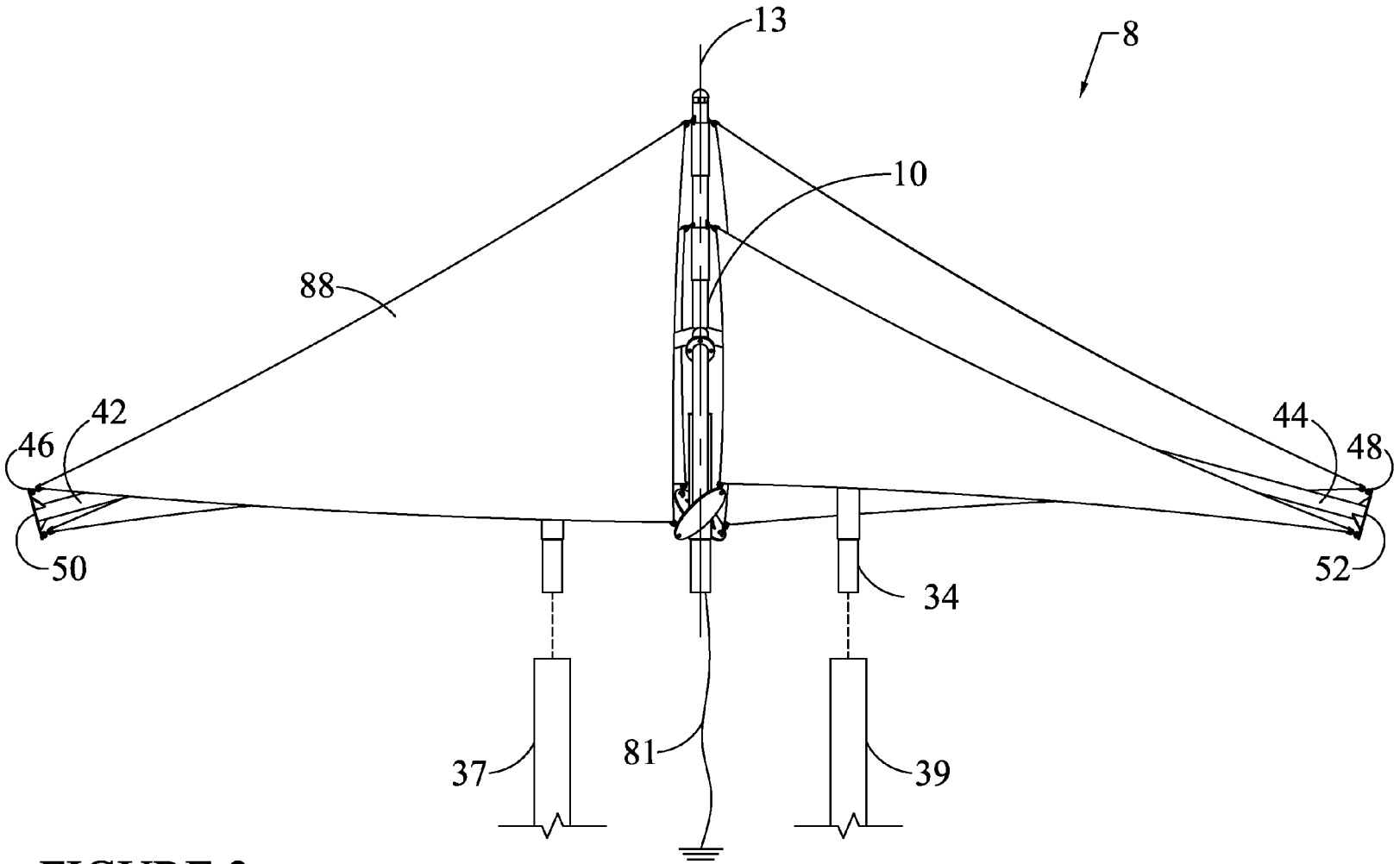
FIG. 2 is a prospective view of the mast supported shade canopy with fabric canopy.

The first cantilever rafter end (50) is disposed on the end of the first cantilever rafter (42), wherein the first cantilever rafter end (50) provides a first engagement means (46) for attaching to the fabric canopy (88), detailed in FIG. 2. The second cantilever rafter end (52) provides a second engagement means (48) for attaching the fabric canopy (88), also detailed in FIG. 2.

A grounding wire (81) is secured to the suspended mast (10) to ground a lightening strike.

FIG. 2 shows an embodiment of the shade structure (8) with a fabric canopy (88) disposed around and over the suspended mast (10), and over the first and second suspended mast support segments (16 and 18) and the first and second cantilever rafters (42 and 44).

Column extensions (34) and (36) are depicted extending from beneath the fabric canopy for insertion within the columns 37 and 39), in this embodiment. Another embodiment contemplates that the extensions (34) and (36) extend over the columns (37 and 39), in a sliding engagement.

Figure 3B:
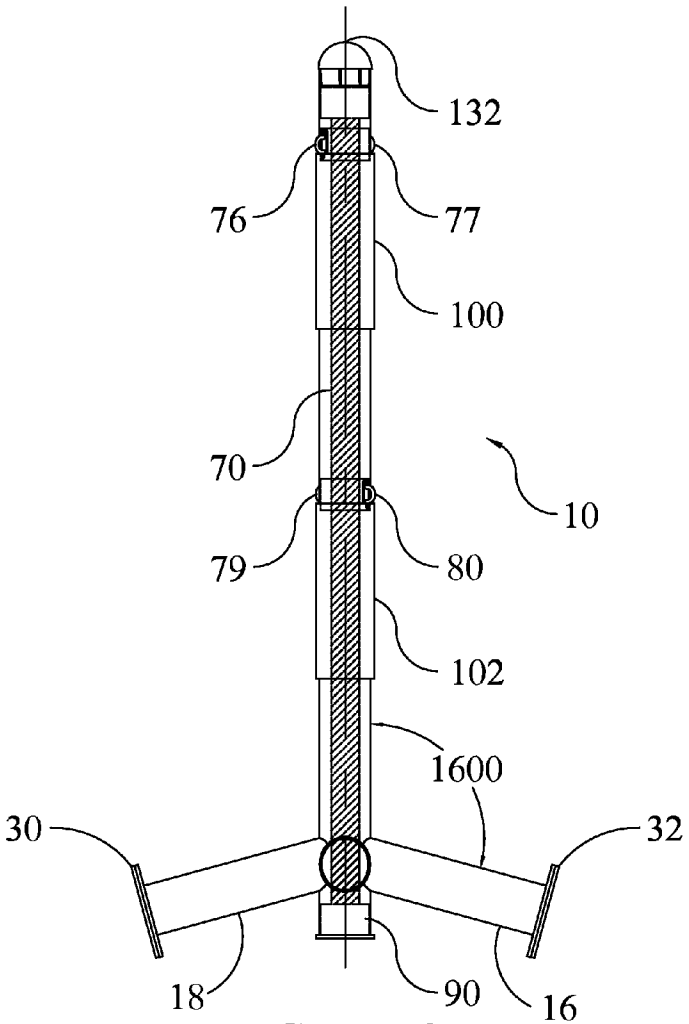
FIG. 3B shows another version of the suspended mast with a cover disposed around the tubular body.
Figure 3A:
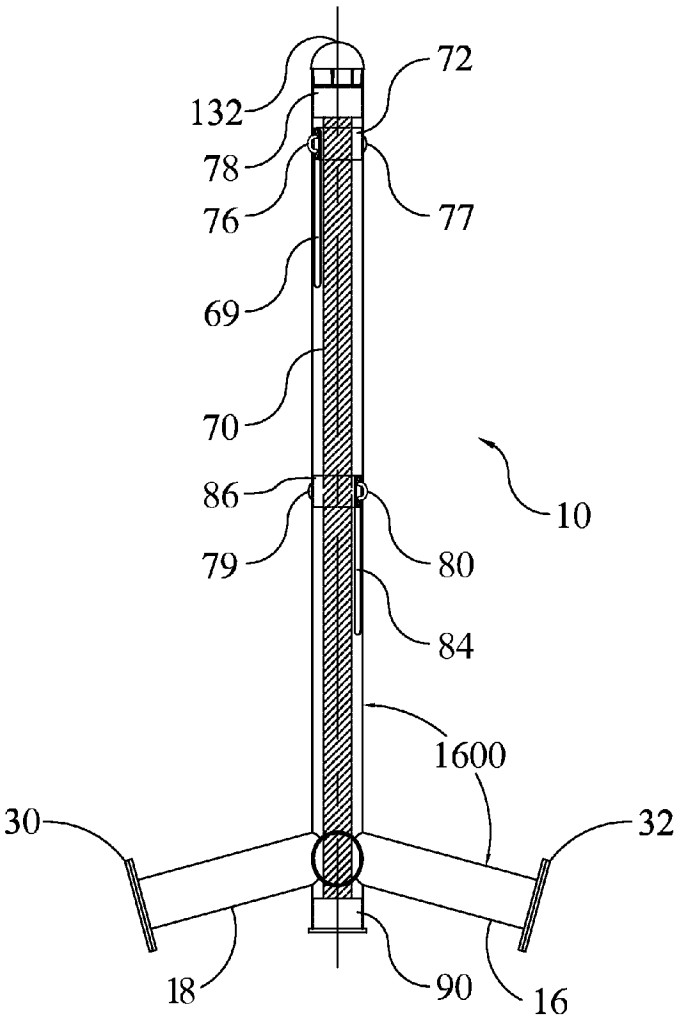
FIG. 3A shows a version of the suspended mast with a cover disposed around the tubular body.

FIGS. 3A and 3B show a detailed view of the suspended mast (10). FIG. 3A shows a first slot (69) and a second slot (84) formed in the tubular member of the suspended mast (10). A rod (70) is supported on one end by the first fitting (78) and is disposed within the tubular member and along the vertical axis adjacent the slots. The rod is shown threaded to a first sliding block (72) and a second sliding block (86) disposed within the tubular member of the suspended mast (10). The sliding blocks move along the rod parallel to the vertical axis. The rod (70) rotates, causing the sliding blocks to travel along the vertical axis, tensioning or releasing tension to the fabric canopy.

Four attaching devices are shown (76, 77, 79 and 80), each for removeably engaging the sliding blocks. The attaching devices are loop structures to which the fabric canopy is tied typically with shackles.

FIG. 3A further depicts the attaching device (76, 77, 79 and 80), shown in this Figure as loops that protrude through the first and second slots (69 and 84).

The first fitting (78) secures the rod (70) on one end, and a second fitting (90) secures the rod (70) on the other end.

The mast support segments (16) and (18) are located between the first and second fittings. In an embodiment the first fitting is adjacent the apex (132) of the suspended mast (10). In still another embodiment a plurality of mast support segments can be disposed between the first and second fitting creating a multi-supported shade structure.

FIG. 3B further shows a version of the suspended mast (10) with a first cover (100) and a second cover (102) disposed around the tubular body covering the slots (69) and (84) respectively. The covers are can have a length from about 6 inches to about 3 feet and a thickness from about 1/32 inch to about 1/8$^{th}$ inch. The covers can be made from metal, plastic coated metal, a durable impact resistant plastic or other non-deformable but flexible material capable of forming a sliding engagement over the slot.

The suspended mast (10) supports the suspended mast support segments (16 and 18) at an angle (1600). Angle (1600) can range from about 90 degrees to about 160 degrees from the vertical axis (13).

Figure 4:
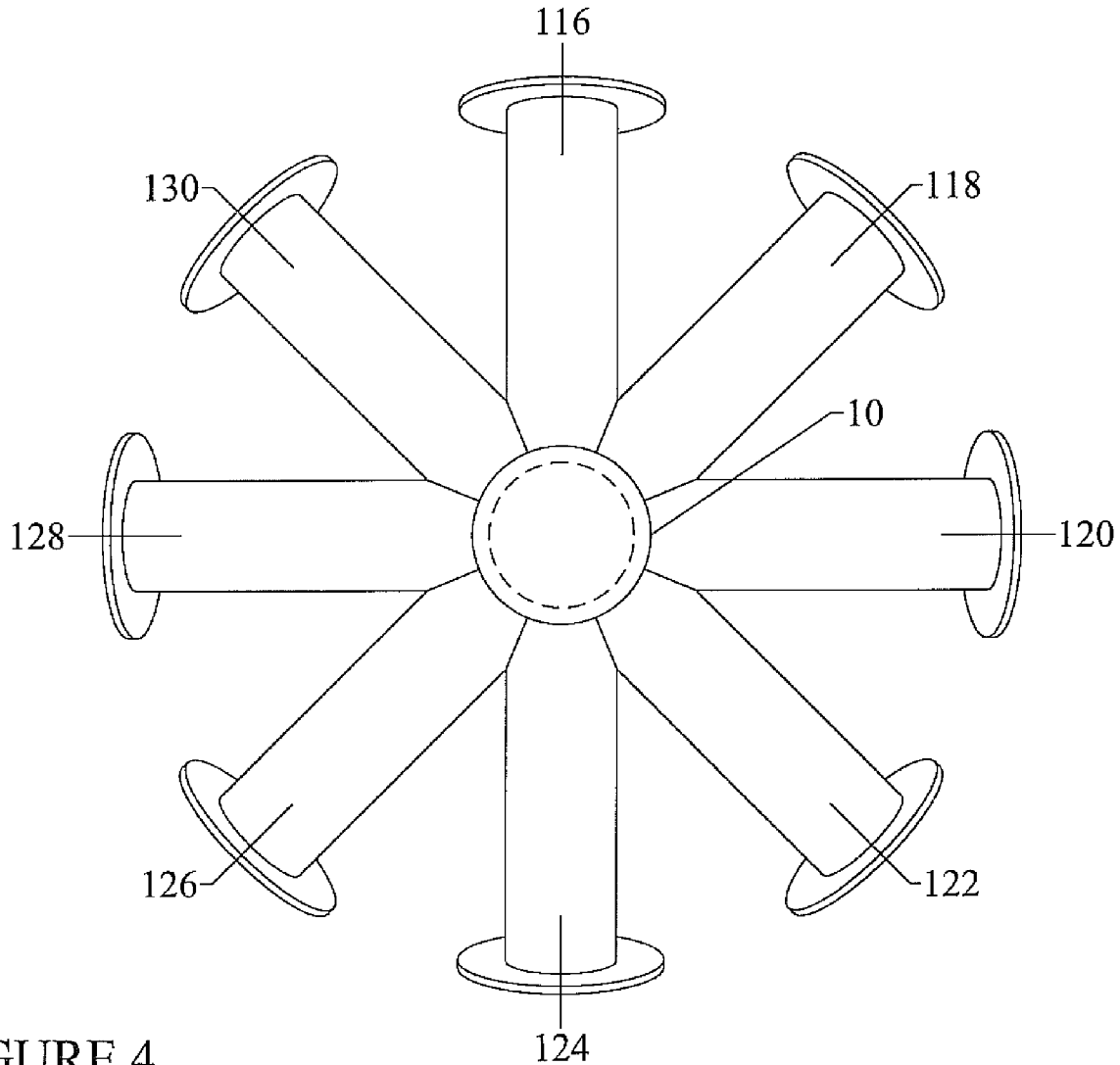
FIG. 4 shows a top view of the mast support segment.

FIG. 4 shows a shade structure from the top view, without the fabric canopy. This embodiment further shows that up to at 8 suspended mast support segments (116, 118, 120, 122, 124, 126, 128, and 130) can be used to engage the tubular of the suspended mast (10). The mast support segments are shown connected to the suspended mast (10). It is contemplated that the mast support segments can all be the same outer diameter and could be hollow or solid. If hollow, the embodiment is very light to ship, yet provides incredible strength in high winds. The mast support segments can be of unequal lengths depending on the needs of the user, and one can be about 2 feet long, another can be about 10 feet long, or all could be the same length.

Figure 5:
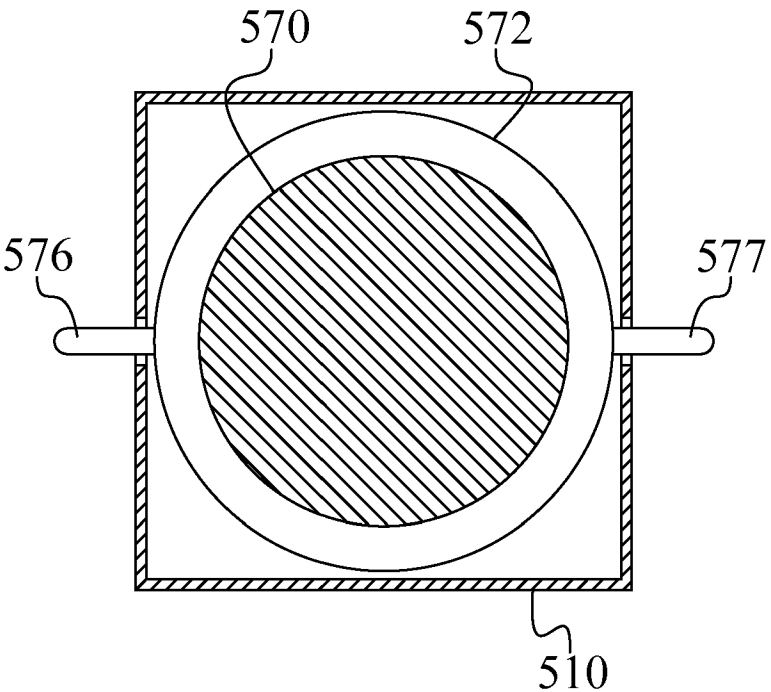
FIG. 5 shows the tubular body of the suspended mast having a rectangular shape.

FIG. 5 shows the tubular body of the suspended mast (510) having a rectangular shape. The rod (570) is shown threaded to a first sliding block (572), and is disposed within the tubular body. Two of the attaching devices (576, 577) are shown.

Figure 6:
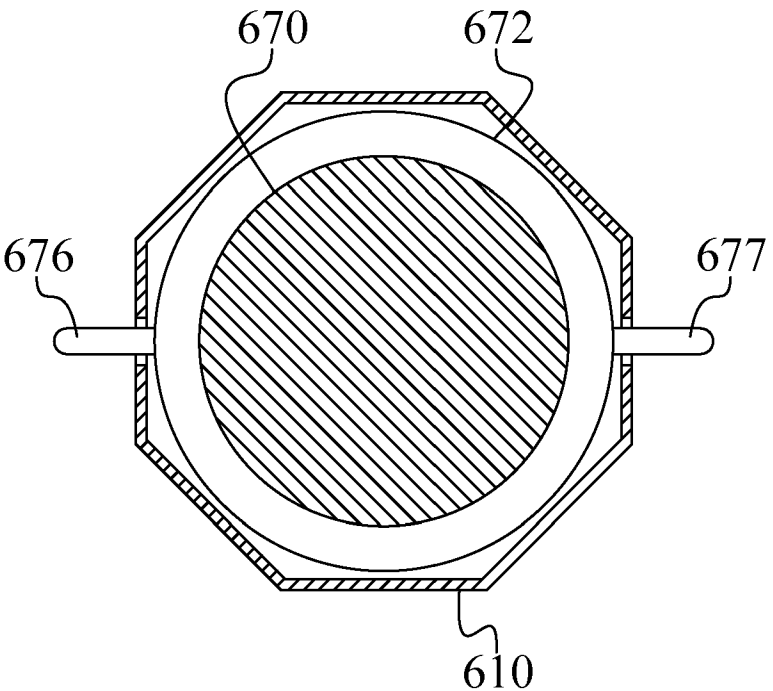
FIG. 6 shows the tubular body of the suspended mast having an octagonal shape.

FIG. 6 shows the tubular body of the suspended mast (610) having an octagonal shape. The rod (670) is shown threaded to a first sliding block (672), and is disposed within the tubular body. Two of the attaching devices (676, 677) are shown.

While these embodiments have been described with emphasis on the embodiments, it should be understood that within the scope of the appended claims, the embodiments might be practiced other than as specifically described herein.

What is claimed is:

1. A shade structure comprising:

a suspended mast comprising a tubular body with a vertical axis, and wherein the suspended mast is non-removably secured between a first suspended mast support segment and a second suspended mast support segment, and wherein the suspended mast supports the suspended mast support segments at an angle between 90 and 160 degrees from the vertical axis;

at least a first flange plate connecting the first suspended mast support segment to a first cantilever rafter and a second flange plate connecting the second suspended mast support segment to a second cantilever rafter;

at least one column extension assembly for simultaneously supporting the cantilever rafters and connecting each cantilever rafter to a column;

a fabric canopy disposed around the suspended mast and over the suspended mast support segments and the cantilever rafters, wherein the fabric canopy is connected to a cantilever rafter end of each cantilever rafter; and a tensioner disposed on the suspended mast, wherein the tensioner comprises:

a slot formed along a vertical axis of the suspended mast;

a rod disposed along the vertical axis, wherein the rod is within the suspended mast;

a sliding block threadably connected to the rod, wherein the sliding block is disposed within the suspended mast;

an attaching device removeably connected to the sliding block and at least partially protruding through the slot, wherein the attaching device is connected to a portion of the canopy; and a first fitting securing the rod to the mast.

2. The shade structure of claim 1, wherein the attaching device can be a pad eye, a hook, bolt, eye bolt, or combinations thereof.

3. The shade structure of claim 1, further comprising a grounding wire secured to the suspended mast to ground a lightening strike.

4. The shade structure of claim 1, wherein the tubular body is cylindrical in shape, rectangular in shape, octagonal in shape or have the shape of another polygon.

5. The shade structure of claim 1, wherein the suspended mast further has at least one cover disposed over the slot and around the tubular body.

6. The shade structure of claim 1, wherein between two suspended mast support segments and eight suspended mast support segments are connected to the suspended mast forming a hub.

7. The shade structure of claim 1, further comprising a connector piece for securing each column extension assembly over each column.

* * * * *